US007736829B2

(12) United States Patent
Silcoff et al.

(10) Patent No.: US 7,736,829 B2
(45) Date of Patent: Jun. 15, 2010

(54) CHARGE ADJUVANTS IN ELECTROSTATIC INKS

(75) Inventors: Elliad Silcoff, Ramat Gan (IL); Yaffa Israeli, Tel Aviv (IL); Gregory Katz, Holon (IL); Albert Teishev, Rishon le-zion (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 529 days.

(21) Appl. No.: 11/651,281

(22) Filed: Jan. 9, 2007

(65) Prior Publication Data

US 2008/0163789 A1 Jul. 10, 2008

(51) Int. Cl.
*G03G 9/135* (2006.01)

(52) U.S. Cl. ..... 430/115; 106/31.6; 106/31.66; 106/31.67; 106/31.9; 430/112

(58) Field of Classification Search ..... 106/31.6, 106/31.66, 31.67, 31.9; 430/115
See application file for complete search history.

(56) References Cited

U.S. PATENT DOCUMENTS

| | | | | |
|---|---|---|---|---|
| 5,366,840 | A | 11/1994 | Larson et al. | |
| 5,451,483 | A * | 9/1995 | Fuller et al. | 430/114 |
| 5,942,365 | A | 8/1999 | Gibson et al. | |
| 6,002,893 | A | 12/1999 | Caruthers, Jr. et al. | |
| 6,376,147 | B1 | 4/2002 | Bonsignore et al. | |

FOREIGN PATENT DOCUMENTS

| | | | |
|---|---|---|---|
| KR | 10-0601656 | B1 | 7/2006 |

OTHER PUBLICATIONS

EP SR dated Feb. 2, 2010.

* cited by examiner

*Primary Examiner*—Mark F Huff
*Assistant Examiner*—Peter L Vajda

(57) ABSTRACT

Ink toners, electroink compositions, methods of making ink toners, methods of making electroink compositions, and the like, are described.

12 Claims, 5 Drawing Sheets

Aluminum Distearate Monohydroxide
Main Component in VCA

Aluminum Monostearate
Monobenzonate Hydroxide

CHARGE ADJUVANTS IN ELECTROSTATIC INKS

CROSS REFERENCE TO RELATED APPLICATIONS

This application is related to copending U.S. utility patent application entitled "POLYMERIC CHARGE ADJUVANTS IN ELECTROSTATIC INKS" filed on the date here evenwith, to Silcoff et al., and accorded Ser. No. 11/651,279, which is entirely incorporated herein by reference.

BACKGROUND

Various techniques for electrostatic image transfer are known. One method includes the use of an intermediate transfer member. A liquid image, which includes a liquid carrier having ink particles dispersed therein, is transferred to a photoconductive member or drum and from there to a surface (e.g., a release layer or blanket) of the intermediate transfer member. The liquid image is attracted from the photoconductive surface to the surface of the intermediate transfer member. The liquid carrier is removed from the surface of the intermediate transfer member and the ink particles are compacted on the surface in the image configuration. Thereafter, the ink particles are transferred from the surface of the intermediate transfer member to a substrate in the image configuration.

Modern liquid toner electrostatic imaging began with the invention of a new class of toners referred to as ElectroInk™. Although not intending to be bound by theory, this type of toner is characterized by its toner particles being dispersed in a carrier liquid, where the toner particles include a core of a polymer with fibrous extensions extending from the core. When the toner particles are dispersed in the carrier liquid in a low concentration, the particles remain separate. Although not intending to be bound by theory, when the toner develops an electrostatic image, the concentration of toner particles increases and the fibrous extensions interlock. A large number of patents and patent applications are directed toward this type of toner (e.g., U.S. Pat. Nos. 4,794,651; 4,842,974; 5,047,306; 5,407,307; 5,192,638; 5,208,130; 5,225,306; 5,264,312; 5,266,435; 5,286,593; 5,300,390; 5,346,796; 5,407,771; 5,554,476; 5,655,194; 5,792,584 and 5,5923,929 and PCT Patent publication WO/92/17823, the entire disclosures of all of which are incorporated herein by reference).

It has been discovered that this type of toner allows for high quality offset like printing quality at high speed. This type of printing is described the following U.S. Pat. Nos. 4,678,317; 4,860,924; 4,980,259; 4,985,732; 5,028,964; 5,034,778; 5,047,808; 5,078,504; 5,117,263; 5,148,222; 5,157,238; 5,166,734; 5,208,130; 5,231,454; 5,255,058; 5,266,435; 5,268,687; 5,270,776; 5,276,492; 5,278,615; 5,280,326; 5,286,948; 5,289,238; 5,315,321; 5,335,054; 5,337,131; 5,376,491; 5,380,611; 5,426,491; 5,436,706; 5,497,222; 5,508,790; 5,527,652; 5,552,875; 5,555,185; 5,557,376; 5,558,970; and 5,570,193; the entire disclosures of which are incorporated herein by reference.

SUMMARY

Briefly described, embodiments of this disclosure include ink toners, electroink compositions, methods of making ink toners, methods of making electroink compositions, and the like. One exemplary embodiment of an ink toner, among others, includes: a charge adjuvant, a carrier liquid, a resin, a pigment, and a charge director, wherein the charge adjuvant is a metal alkoxylate compound, and wherein the ink toner does not include aluminum stearate.

One exemplary embodiment of a method of making an electrostatic ink, among others, includes: grinding a carrier liquid, a resin, and a pigment, to form an ink slurry; mixing a charge adjuvant and a charge director with the ink slurry after grinding, wherein the charge adjuvant is a metal alkoxylate compound, and wherein the ink toner does not include aluminum stearate; and forming the electrostatic ink.

One exemplary embodiment of a method of making an electrostatic ink, among others, includes: grinding a charge adjuvant, a carrier liquid, a resin, a pigment, and a charge director together to form an ink toner, wherein the charge adjuvant is a metal alkoxylate compound, and wherein the ink toner does not include aluminum stearate; and forming the electrostatic ink.

BRIEF DESCRIPTION OF THE DRAWINGS

Many aspects of this disclosure can be better understood with reference to the following drawings. The components in the drawings are not necessarily to scale. Moreover, in the drawings, like reference numerals designate corresponding parts throughout the several views.

DETAILED DESCRIPTION

Figure 1:
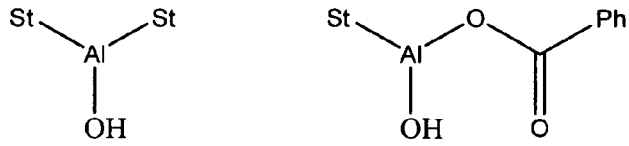
FIG. 1 the chemical formula of aluminum stearate (modeled as aluminum distearate), the most abundant compound present and aluminum monostearate monobenzoate hydroxide (ASBH).
Figure 2:
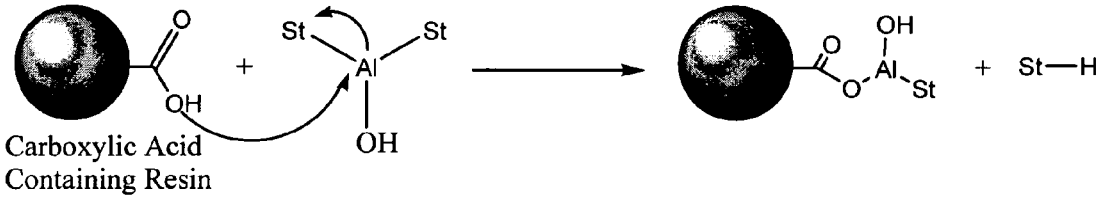
FIG. 2 illustrates a reaction of ink resin with aluminum stearate, where St=Stearate (modeled as aluminum distearate, the most abundant compound present in aluminum stearate).
Figure 3:
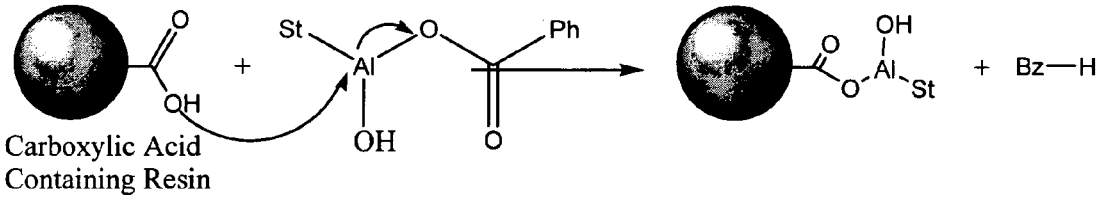
FIG. 3 illustrates a reaction of an ink resin with aluminum monostearate monobenzoate hydroxide (St=Stearate, and Bz=benzoate).
Figure 4:
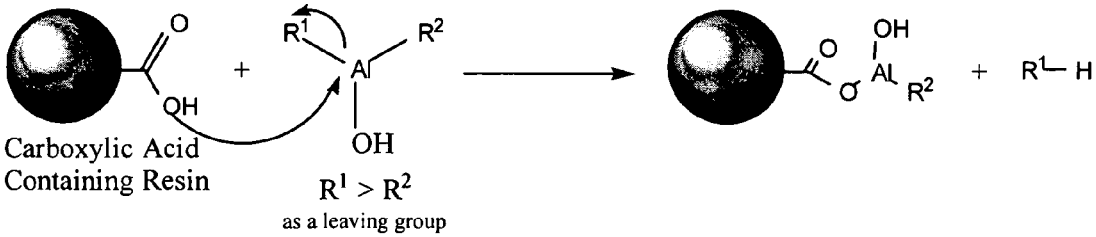
FIG. 4 illustrates a reaction of ink resin with a generic aluminum salt.

Embodiments of the present disclosure will employ, unless otherwise indicated, techniques of synthetic organic chemistry, ink chemistry, electrochemistry, chemistry of conducting compounds, media chemistry, printing chemistry, and the like, that are within the skill of the art. Such techniques are explained fully in the literature.

The following examples are put forth so as to provide those of ordinary skill in the art with a complete disclosure and description of how to perform the methods and use the compositions disclosed and claimed herein. Efforts have been made to ensure accuracy with respect to numbers (e.g., amounts, temperature, etc.) but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Discussion

Embodiments of the present disclosure include ink toners including metal alkoxylate compounds (e.g., aluminum monostearate monobenzoate hydroxide (ASBH)) as the charge adjuvant, where metal alkoxylate compounds replace aluminum stearate as the charge adjuvant. In addition, embodiments of the present disclosure include methods of making ink toners including metal alkoxylate compounds as the charge adjuvant. Although metal alkoxylate compounds can be used as the charge adjuvant, a particular metal alkoxylate compound, ASBH, is mentioned below, but embodiments of the present disclosure are not limited to ASBH as the charge adjuvant. As used herein, "charge adjuvant" is an additive added to electrostatic inks that allows the binding and/or activation of the charge control agent/charge director.

In embodiments where the metal alkoxylate compound is ASBH, replacing aluminum stearate with ASBH enables the user to tune the characteristics (e.g., physical and/or electrical characteristics) of the ink toner (FIGS. 1-4 describe chemical formula and reactions related to aluminum stearate and embodiment of the present disclosure). In this regard, the concentration of ASBH can be used to chemically alter the viscosity and/or the electrical characteristics of the ink toner.

In addition, the components of the ink toner can be mixed homogeneously with or in a different order than previously conducted using aluminum stearate as the charge adjuvant. Typically, the charge adjuvant is added prior to grinding, but embodiments of the present disclosure provide for adding ASBH homogeneously to the ink toner after grinding. Additionally, the order in which the components of the ink toner are added can be changed.

Further, the concentration of the charge adjuvant that is used in the ink toner (e.g., high quality or low quality ink toners) is lower (e.g., an order of magnitude lower than when aluminum stearate is used as the charge adjuvant) when ASBH is used as the charge adjuvant, which reduces cost and complexity. Although not intending to be bound by theory, the lower concentration may be attributed to the charge adjuvant being disposed on the charged pigmented particle surface rather than entering the interior of the charged pigmented particle.

In an embodiment, ASBH can be added prior to grinding, which is in the same manner as aluminum stearate is added using current techniques. In this regard, a carrier liquid and a resin are mixed in a mixer (e.g., double planetary mixer and the like). Other components such as, but not limited to, the charge adjuvant, organic/inorganic pigments, surface modifiers, and additives, can be added to the slurry at this stage and/or during the next stage. Next the slurry is added to a grinder (e.g., an attritor, a disk mill, a sand mill, an impeller attrition mill, a vibro-energy mill, or the like), and ground for a period of time to form the ink toner. Using ASBH as the charge adjuvant produces an ink toner having characteristics (e.g., physical and/or electrical characteristics) comparable to or better than ink toners including aluminum stearate as the charge adjuvant (at equivalent amounts the electrical properties are superior). In addition the batch repeatability is superior as the compound is dispersed homogeneously in the slurry and not as a heterogeneous powder like the aluminum stearate. Additional results and discussion are provided in the Examples.

In another embodiment, ASBH can be added after the grinding of the components in the ink toner (e.g., the carrier liquid, the resin, and the like). Addition of the charge adjuvant after grinding allows the user to tune the electrical and physical characteristics of the ink toner. The characteristics that can be tuned include, but are not limited to, viscosity, low field conductivity, high field conductivity, dc conductivity, particle conductivity, total charge and mobility, and combinations thereof. For example, the viscosity of the ink toner can be chemically modified (e.g., decreased) by changing the amount of charge adjuvant homogeneously added to the ink toner.

In another example, a larger concentration of the charge adjuvant can be added to an ink toner having poor or lower quality (e.g., poor quality being defined as ink which develops a low particle conductivity in standard conditions that will exhibit itself in poor printing characteristics, low optical density, poor print quality, poor transfer of small dots, low solid consistence, poor fixing qualities, and the like), while a lower concentration of charge adjuvant can be added to an ink toner having a higher quality. In an embodiment, the amount of charge adjuvant used in the ink toner can be adjusted for the particular ink toner composition and/or use of the in ink toner in a particular developing apparatus. For example, the electrical characteristics of the ink toner can be tuned for a specific developing apparatus, since the electrical characteristics (development window/working window) of each developing apparatus and needs of each system are unique. The ability to tune the ink toner enables the user to produce a superior and a well-defined ink that will result in a superior and more consistent printed product.

In addition to the previous embodiment, it should also be noted that ASBH could be used with different protocols resulting in similarly good results. In addition the usual order of addition, the addition of the charge adjuvant followed by the charge control agent/charge director, two other options are viable. The $1^{st}$ is the addition of the charge director followed by the charge adjuvant and the second is the simultaneous addition of the charge director and charge adjuvant. The addition of the charge director prior to the charge adjuvant and addition of the charge adjuvant and the charge director simultaneously could not be done when the charge adjuvant is aluminum stearate. The order in which the charge adjuvant and the charge director are added may be used to modify characteristics of the ink toner both in production and on the press allowing for the use of the same ink in a different manner. The advantages of adding the charge director prior to the charge adjuvant or adding the charge adjuvant and the charge director simultaneously include simplification of the production protocol. Additional results and discussion are provided in the Examples.

As mentioned above, the ink toner includes, but is not limited to, a polymeric resin, a charge adjuvant, a carrier liquid, a resin, an organic/inorganic pigment, a charge director, a surface modifier, compatibility additives, media additives, fixing additives and other additives. As mentioned above, the charge adjuvant can be added to the mixture prior to grinding or after grinding. In addition, the charge adjuvant can be added before, after, or at the same time as the charge director. The physical and electrical characteristics are described in more detail after the components of the ink toner are described.

As mentioned above, the charge adjuvant includes the metal alkoxylate compound, which can include compounds as described in formula I, formula II, or formula III:

Formula I

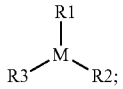

Formula II

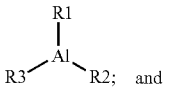

and

Formula III

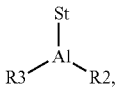

where M is a metal such as, but not limited to, Al, Ba, Na, Mg, Zn, Ca, Zr, Co, Cu, Fe, Ga, B, Si, In, Sn, and other d and f metals. R1 can include stearate, other deprotonated fatty acids (e.g., palmitic and arachidic fatty acids), unsaturated fatty acids (e.g., oleaic and erucic fatty acids) polyunsaturated fatty acids (e.g., linoleic, linolenic, arachidonic fatty acids), linear alkyl groups, branched alkyl groups, aromatics, heteroaromatics, cyclic alkyl groups, and the like. R2 can include hydrogen, OH, or one of the R1 groups listed above. R3 can include a hydroxide, an ester, a sulfonate (e.g., methylsulfonate), a stearate, an acetate, or any one of the R1 groups listed above.

In particular, the charge adjuvant is ASBH. ASBH is soluble in the ink carrier liquid as opposed to other charge adjuvants in standard use (aluminum stearate, other metal stearates, other aluminum alkoxylate salts), which permits the addition of the ASBH after grinding and allows a smaller amount of ASBH to be added to the ink toner. The amount of charge adjuvant used depends, at least in part, upon the particular application, the other components, and the like. The amount of charge adjuvant used can be appropriately adjusted for the particular application. The charge adjuvant is about 0.05% to 5% or about 0.125 to 4% by total weight of the solid fraction of the ink toner. The charge adjuvant is about 0.00625 to 0.2% by total weight of the total ink toner suspension at the working concentration in the ink tank.

The carrier liquid can include, but is not limited to, a low dielectric constant, nonpolar liquid that is used as the medium for toner particles. The carrier liquid can usually include compounds that have a resistivity in excess of about $10^9$ ohm-cm and a dielectric constant below about 3.0, however, higher conductivities can be used as less preferred applications on presses or as working points in other applications. The carrier liquid can include, but is not limited to, hydrocarbons, halogenated hydrocarbons, cyclic hydrocarbons, functionalized hydrocarbons (where functionalized can include alcohols, acids, esters, ethers, sulfonic acids, sulfonic acid esters, and the like). The hydrocarbon can include, but is not limited to, an aliphatic hydrocarbon, an isomerized aliphatic hydrocarbon, branched chain aliphatic hydrocarbons, aromatic hydrocarbons, and combinations thereof.

Illustrative carrier liquids include, but are not limited to, aliphatic hydrocarbon, isoparaffinic compounds, paraffinic compounds, dearomatized hydrocarbon compounds, and the like. In particular, the carrier liquids can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and electron, positron, new II, purogen HF (100% synthetic terpenes) (sold by ECOLINK). The carrier liquid is about 55 to 99% by total weight of the ink toner.

The resin can include, but is not limited to, thermoplastic toner resins. In particular, the resin can include, but is not limited to, ethylene acid copolymers; ethylene acrylic acid copolymers; methacrylic acid copolymers; ethylene vinyl acetate copolymers; copolymers of ethylene (60 to 99.9%), acrylic, or methacrylic acid (40 to 0.1%)/alkyl (C1 to C20)) ester of methacrylic or acrylic acid (0.1 to 20%); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g., copolymer of acrylic or methacrylic acid and at least one alkyl ester of acrylic or methacrylic acid wherein alkyl is from 1 to about 20 carbon atoms, like methyl methacrylate (50 to 90%)/methacrylic acid (0 to 20 percent/ethylhexylacrylate (10 to 50%)); ethylene-acrylate terpolymers: ethylene-acrylic esters-maleic anhydride (MAH) or glycidyl methacrylate (GMA) terpolymers; low molecular weight ethylene-acrylic acid ionomers and combinations thereof.

In an embodiment, the resin can include the Nucrel family of resins (e.g., Nucrel 403™, Nucrel 407™, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX 76™, Nucrel 2806™, Bynell 2002, Bynell 2014, and Bynell 2020 (sold by E. I. du PONT)), the Aclyn family of resins (e.g. Aclyn 201, Aclyn 246, Aclyn 285, and Aclyn 295), and the Lotader family of resins (e.g. Lotader 2210, Lotader, 3430, and Lotader 8200 (sold by Arkema)). The resin is about 5% to 100% by total weight of the ink toner.

The colorants can include, but are not limited to, cyan colorants, magenta colorants, yellow colorants, violet colorants, orange colorants, green colorants colorants, black colorants, and combinations thereof. Colorants used in conjunction with ElectroInk® based systems are known in the art. The pigment is about 0% to 80% by total weight of the ink toner.

The charge director can include, but is not limited to, lecithin, oil-soluble petroleum sulfonates (e.g., neutral Calcium Petronate™, neutral Barium Petronate™, and basic Barium Petronate™), polybutylene succinimides (e.g., OLOA™ 1200 and Amoco 575), and glyceride salts (e.g., sodium salts of phosphated mono- and diglycerides with unsaturated and saturated acid substituents), sulfonic acid salts including, but not limited to, barium, sodium, calcium, and aluminum salts of sulfonic acid. The sulfonic acids may include, but are not limited to, alkyl sulfonic acids, aryl sulfonic acids, and sulfonic acids of alkyl succinates. In addition, the charge director as described in (PCT/US2006/018297 filed on May 10, 2006, which is incorporated herein by reference) can be used as well. The charge director is about 0.001 to 5% by total weight of the ink toner.

The ink toner has a viscosity of about 50 to 1000 depending of ink particle morphology, additive concentration, % NVS, and other options. The viscosity of the ink toner can be modified by changing the concentration of the charge adjuvant added to the ink toner. The viscosity change takes place while maintaining the original ink morphology. This can be provide fixing qualities, usually obtainable, from higher viscosity inks, (which are difficult to print) with low viscosity inks. In addition, the production of ink at very low viscosities enables placing much higher concentrations in the ink cans, which has both a financial advantage and a technical advantage in that there are fewer limitations as to at what concentration the ink can be developed at.

The ink toner has a low field conductivity of about 4 pS to 300 pS or about 8 pS to 150 pS. The low field conductivity of the ink toner can be modified by changing the concentration of the charge adjuvant added to the ink toner.

The ink toner has a high field conductivity of about 10 pS to 500 pS. The high field conductivity of the ink toner can be modified by changing the concentration of the charge adjuvant added to the ink toner.

While embodiments of the present disclosure are described in connection with Examples 1-3 and the corresponding text and figures, there is no intent to limit the disclosure to the embodiments in these descriptions. On the contrary, the intent is to cover all alternatives, modifications, and equivalents included within the spirit and scope of embodiments of the present disclosure.

Example 1

Grinding Ink with ASBH

Figure 5:
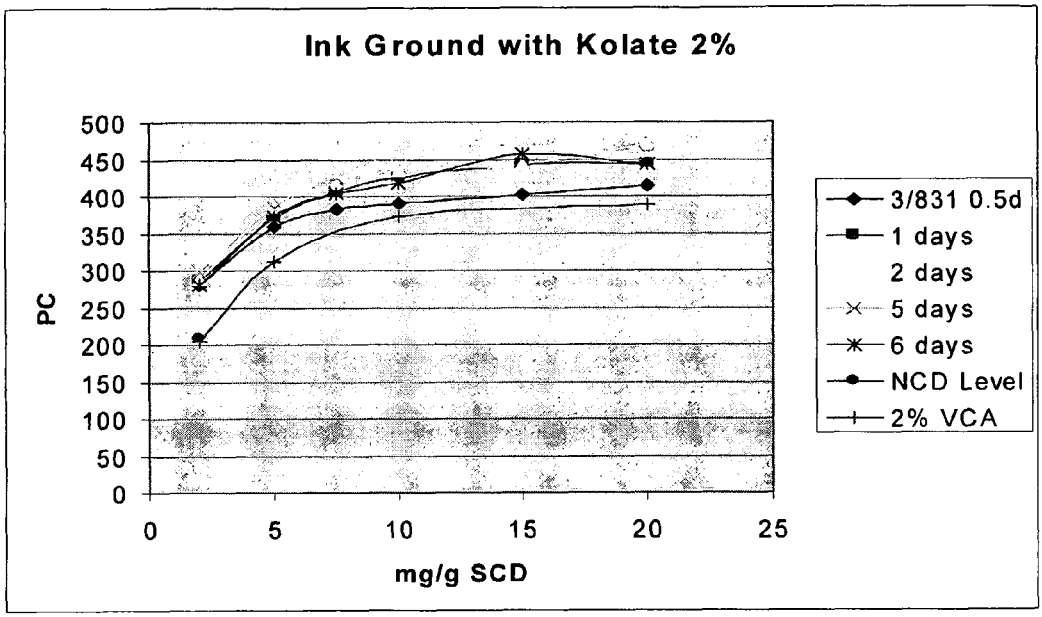
FIG. 5 illustrates a graph of a charging profile of ink ground with 2% ASBH (as Kolate 6030 from Federal Process) vs. ink ground with 2% VCA.
Figure 6:
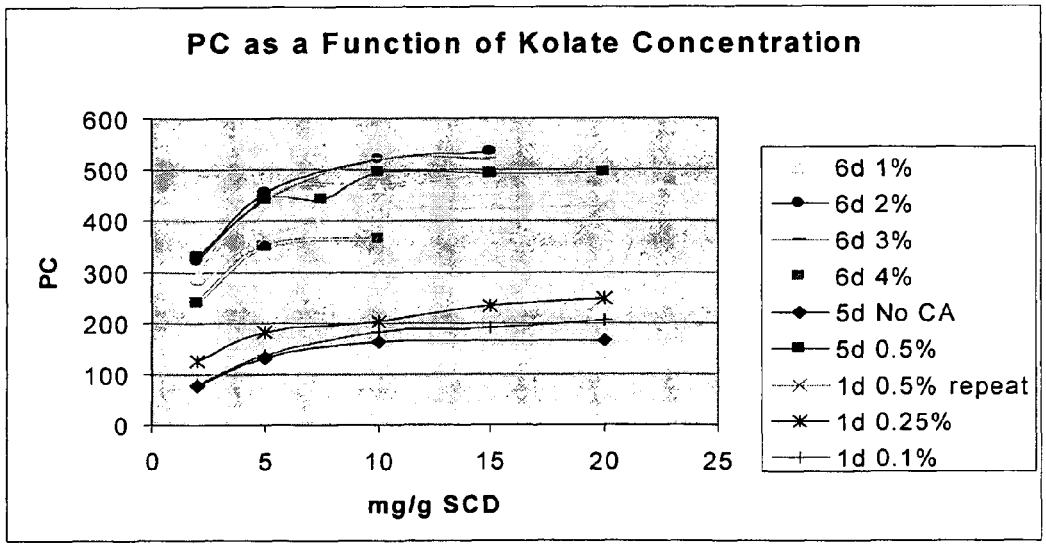
FIGS. 6-10 illustrates graphs of charging profiles for ink treated homogeneously with ASBH.
Figure 7:
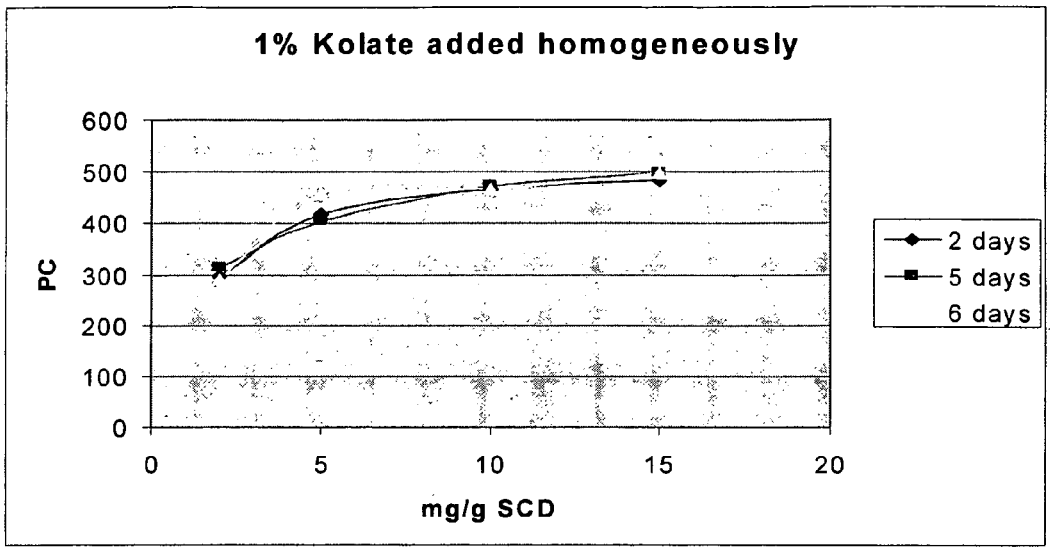
Figure 8:
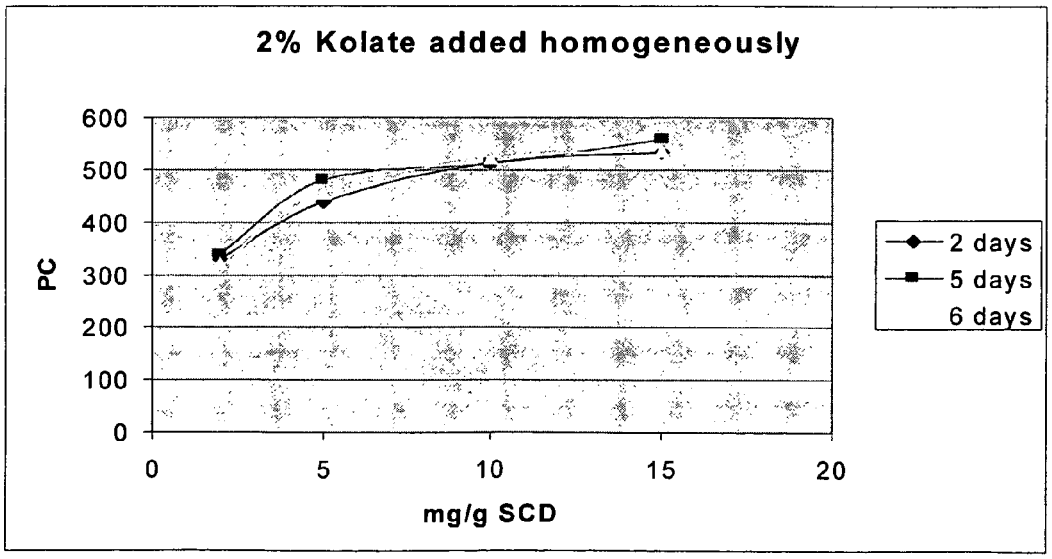
Figure 9:
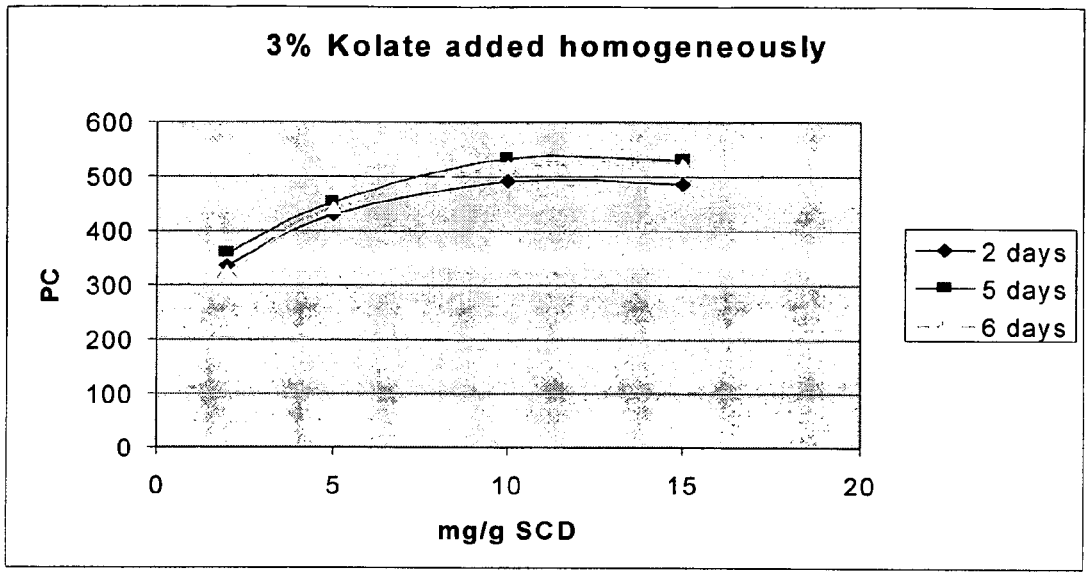
Figure 10:
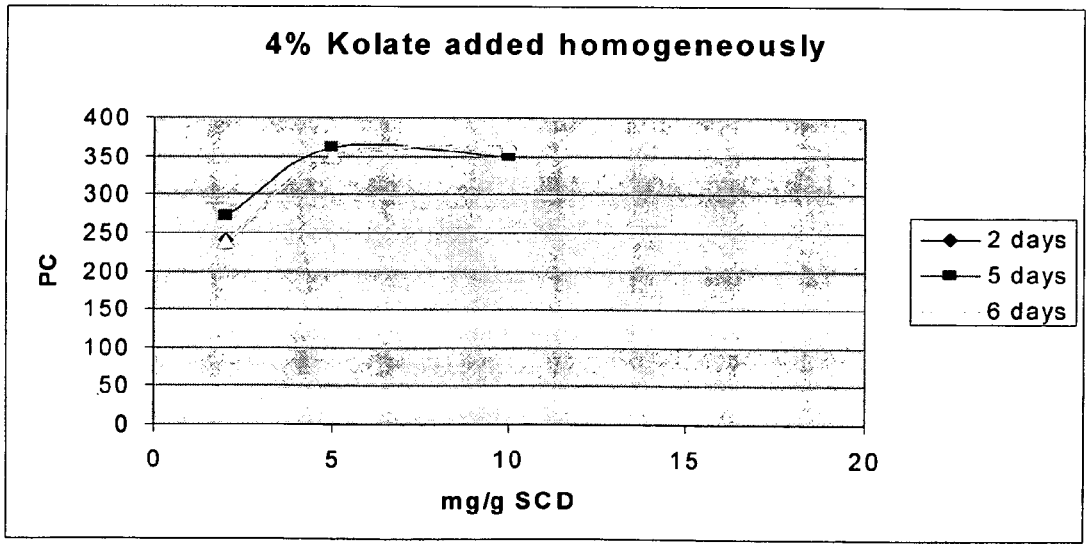

Ink ground with ASBH (According to the formulation of ElectroInk 5.0 rev. 1.3 but not limited to this formulation) gave a value slightly in excess of that ground with VCA. However the differences are within the range of error. This may suggest that in effect the same ink is being developed and the only difference is in the nature of the leaving group (see FIG. 5). A main difference of the ink ground with ASBH was the very low viscosity, 66.5 cPs relative to standard 5.0 rev. 1.2, ~200 cPs.

Example 2

Homogeneous Addition of ASBH

Ink prepared without any charge adjuvant and then treated with ASBH charges very quickly and to a very high level of PC. 4% ASBH showed a decline in activity that can be traced to an increase in LF. This suggests a saturation point somewhere between 3 and 4% with the rest of the ASBH staying in the supernatant All are significantly higher than the untreated ink (see FIGS. 6-11).

Figure 11:
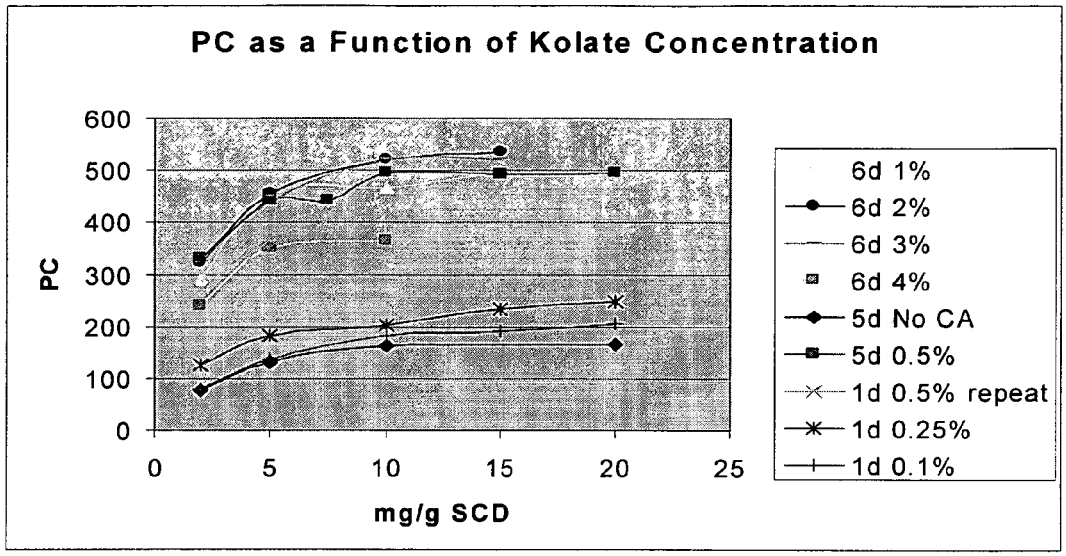
FIG. 11 illustrates a graph showing PC at several concentrations of ASBH.
Figure 12:
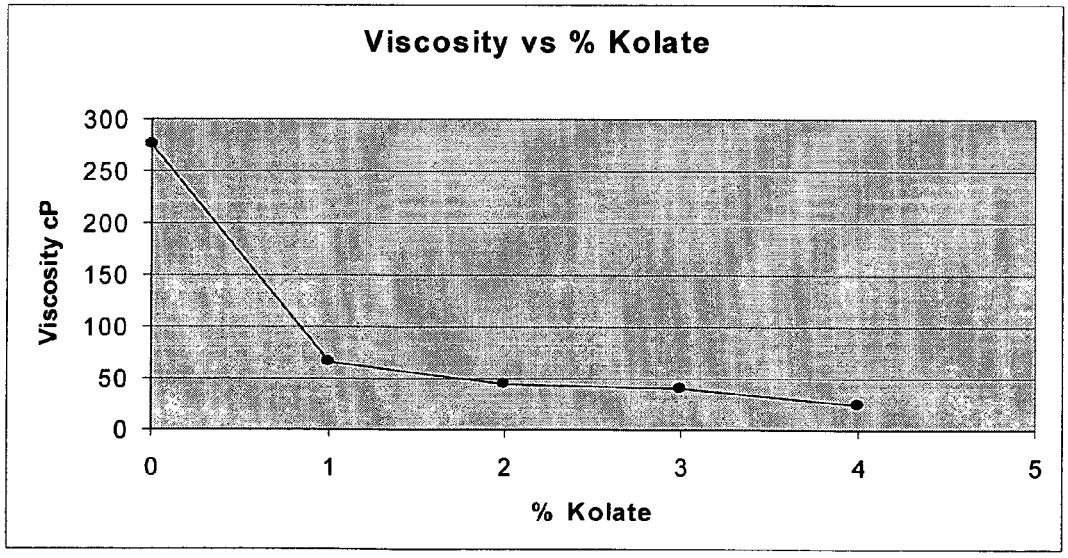
FIG. 12 illustrates a graph showing the change of viscosity as a function of ASBH %.

Several more points were tested to understand where the working point is with ASBH. Based on the FIG. 6 a suggested working point would be at about 0.375% ASBH that will put us at a pc of 270 or developer roller voltage of 450. The higher level of PC can likely be attributed to the ASBH being concentrated on the surface of the ink particle (FIG. 11). This is enforced by the severe drop in viscosity see as a function of ASBH amount (FIG. 12).

Example 3

Effect of ASBH on Viscosity

The addition of ASBH can significantly change the viscosity of the inks as measured by standard measurements at 8.4%. This allows post-grinding modification of the ink without changing the morphology of the ink particle. The advantage of this is the ability to work at much high concentrations and thus save in the expenditure of ink cans and attune the ink the flow needed in the specific application (FIG. 12).

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range.

TABLE 1

| Date | Batch | Form. | w/w, % | NVS, % | Prep G.T.; Temp. | P.S. d(0.5) micron | PC | dC | DMA | OD | dE | d90 μm | L, a, b |
|---|---|---|---|---|---|---|---|---|---|---|---|---|---|
| 14.2.06 | 3/831 | L:ACE = 9:1 | 79.0 | 18 | 52 C. 1.5 h | | | | | | | | |
| | | TB5 | 13.0 | | 40 C. 10.5 h | | | | | | | | 55.6 |
| | | BSG 87 | 1.0 | S1/A | | | | | | | | | −25.1 |
| | | ASBH | 2.0 | | 250 rpm | | | | | | | | −48.1 |
| | | HPB | 2.0 | | | | | | | | | | |
| | | MCB | 3.0 | | | 5.32 | 207 | 12.0 | 0.090 | 1.42 | 2.9 | 11.6 | |
| | | | | | Reference: | | | | | | | | |
| 14.2.06 | 3/830 | L:ACE = 9:1 | 79.0 | 18 | 52 C. 1.5 h | | | | | | | | |
| | | TB5 | 13.0 | | 40 C. 10.5 h | | | | | | | | 55.6 |
| | | BSG 87 | 1.0 | S1/A | | | | | | | | | −25.1 |
| | | VCA | 2.0 | | 250 rpm | | | | | | | | −48.1 |
| | | HPB | 2.0 | | | | | | | | | | |
| | | MCB | 3.0 | | | 5.32 | 207 | 12.0 | 0.090 | 1.42 | 2.9 | 11.6 | |

Many variations and modifications may be made to the above-described embodiments. All such modifications and variations are intended to be included herein within the scope of this disclosure and protected by the following claims.

The invention claimed is:

1. An ink toner, comprising:

a charge adjuvant selected from aluminum monostearate monobenzoate hydroxide;

a carrier liquid;

a resin;

a pigment; and a charge director, wherein the ink toner does not include aluminum stearate.

2. The ink toner of claim 1, wherein ink toner has a viscosity of about 20 cPs to 600 cPs.

3. The ink toner of claim 1, wherein the aluminum monostearate monobenzoate hydroxide is about 0.05 to 4% by total weight of ink solids in the ink toner.

4. The ink toner of claim 1, wherein the aluminum monostearate monobenzoate hydroxide is about 0.125 to 4% by total weight of ink solids in the ink toner.

5. The ink toner of claim 1, wherein the electrostatic ink toner has a low field conductivity of about 4 pS to 300 pS.

6. A method of making an ink toner, comprising:

grinding a carrier liquid, a resin, and a pigment, to form a slurry; and mixing a charge adjuvant and a charge director with the slurry after grinding, wherein the charge adjuvant is aluminum monostearate monobenzoate hydroxide, and wherein the ink toner does not include aluminum stearate.

7. The method of claim 6, wherein mixing includes:

mixing the charge adjuvant with the slurry homogeneously prior to mixing the charge director with the ink slurry.

8. The method of claim 6, wherein mixing includes:

mixing the charge director and the charge adjuvant simultaneously to the ink slurry.

9. The method of claim 6, wherein mixing includes:

mixing the charge director prior to adding the charge adjuvant to the ink slurry.

10. The method of claim 6, wherein the charge adjuvant added to the to the ink slurry at multiple times during the preparation of the ink toner.

11. The method of claim 6, further comprising:

adding the charge adjuvant to change a characteristic selected from: viscosity of the ink toner, conductivity of the ink toner, and combinations thereof, wherein the addition of the charge adjuvant does not change a particle shape or a morphology of the ink toner.

12. A method of making an electrostatic ink, comprising:

grinding a charge adjuvant, a carrier liquid, a resin, a pigment, and a charge director together to form an ink toner, wherein the charge adjuvant is aluminum monostearate monobenzoate hydroxide, and wherein the ink toner does not include aluminum stearate; and forming the electrostatic ink.

* * * * *

UNITED STATES PATENT AND TRADEMARK OFFICE

CERTIFICATE OF CORRECTION

PATENT NO. : 7,736,829 B2
APPLICATION NO. : 11/651281
DATED : June 15, 2010
INVENTOR(S) : Elliad Silcoff et al.

It is certified that error appears in the above-identified patent and that said Letters Patent is hereby corrected as shown below:

In column 9, line 23, in Claim 5, after "wherein the" delete "electrostatic".

Signed and Sealed this
Twenty-sixth Day of April, 2011

David J. Kappos

David J. Kappos
*Director of the United States Patent and Trademark Office*